US007347419B2

(12) United States Patent
Sano et al.

(10) Patent No.: US 7,347,419 B2
(45) Date of Patent: Mar. 25, 2008

(54) SHEET SUPPLYING DEVICE, IMAGE READING APPARATUS HAVING THE SAME AND METHOD OF DETECTING OVERLAPPING SHEETS

(75) Inventors: Kazuhide Sano, Yamanashi-ken (JP); Syunichi Hirose, Minami-alps (JP); Masashi Yamashita, Kofu (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 497 days.

(21) Appl. No.: 11/020,249

(22) Filed: Dec. 27, 2004

(65) Prior Publication Data

US 2005/0140087 A1 Jun. 30, 2005

(30) Foreign Application Priority Data

Dec. 24, 2003 (JP) ..... 2003-428192

(51) Int. Cl.
*B65H 7/02* (2006.01)

(52) U.S. Cl. ..... 271/265.04; 271/262; 271/242

(58) Field of Classification Search ... 271/256–258.05, 271/265.01–265.04, 10.02, 10.03, 262–263, 271/242, 260; 358/498; 399/367, 371
See application file for complete search history.

(56) References Cited

U.S. PATENT DOCUMENTS 5,222,724 A * 6/1993 Hirano et al. ..... 271/10.11
5,362,041 A * 11/1994 Ryuzaki et al. ..... 271/236
6,040,923 A * 3/2000 Takashimizu et al. ..... 358/498
6,565,079 B1 * 5/2003 Kakegawa et al. ..... 271/125
2001/0042956 A1 * 11/2001 Minoru et al. ..... 271/265.04

FOREIGN PATENT DOCUMENTS

JP 6-49567 12/1994
JP 10-257595 9/1998

* cited by examiner

*Primary Examiner*—Patrick Mackey
*Assistant Examiner*—Jeremy R Severson
(74) *Attorney, Agent, or Firm*—Manabu Kanesaka

(57) ABSTRACT

A sheet supplying device includes a stacker for placing sheets; a delivery device for separating and feeding the sheets on the stacker; a register device for temporarily holding a sheet; a sheet conveying guide for guiding the sheet from the register device to a processing position; a sheet sensor disposed between the delivery device and the register device for detecting the sheet; at least one driving device for driving the delivery device and the register device; a conveyance control device for controlling the driving device so that the delivery device and the register device form a loop of the sheet according to a signal from the sheet sensor and an overlap sensor disposed between the register device and the processing position for detecting overlapping of the sheet. An overlap determining device determines overlapping of the sheet according to signals from the sheet sensor and the overlap sensor.

17 Claims, 11 Drawing Sheets

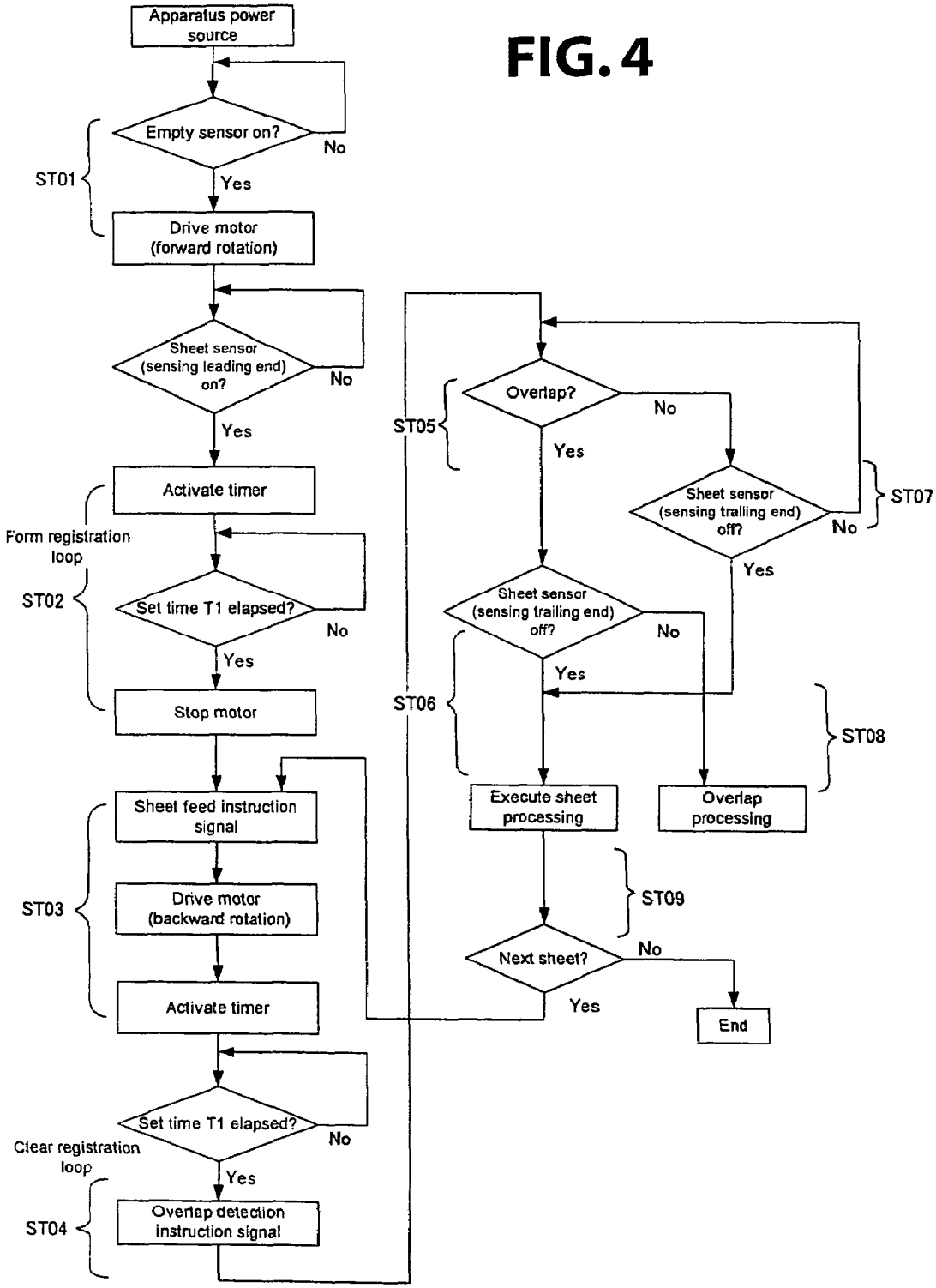
FIG. 4
Apparatus power source
Empty sensor on?
No
Yes
ST01
Drive motor (forward rotation)
Sheet sensor (sensing leading end) on?
No
Yes
Activate timer
Form registration loop
ST02
Set time T1 elapsed?
No
Yes
Stop motor
Sheet feed instruction signal
ST03
Drive motor (backward rotation)
Activate timer
Set time T1 elapsed?
No
Clear registration loop
Yes
ST04
Overlap detection instruction signal
Overlap?
No
ST05
Yes
Sheet sensor (sensing trailing end) off?
No
ST07
Yes
Sheet sensor (sensing trailing end) off?
No
Yes
ST06
ST08
Execute sheet processing
Overlap processing
ST09
Next sheet?
No
Yes
End

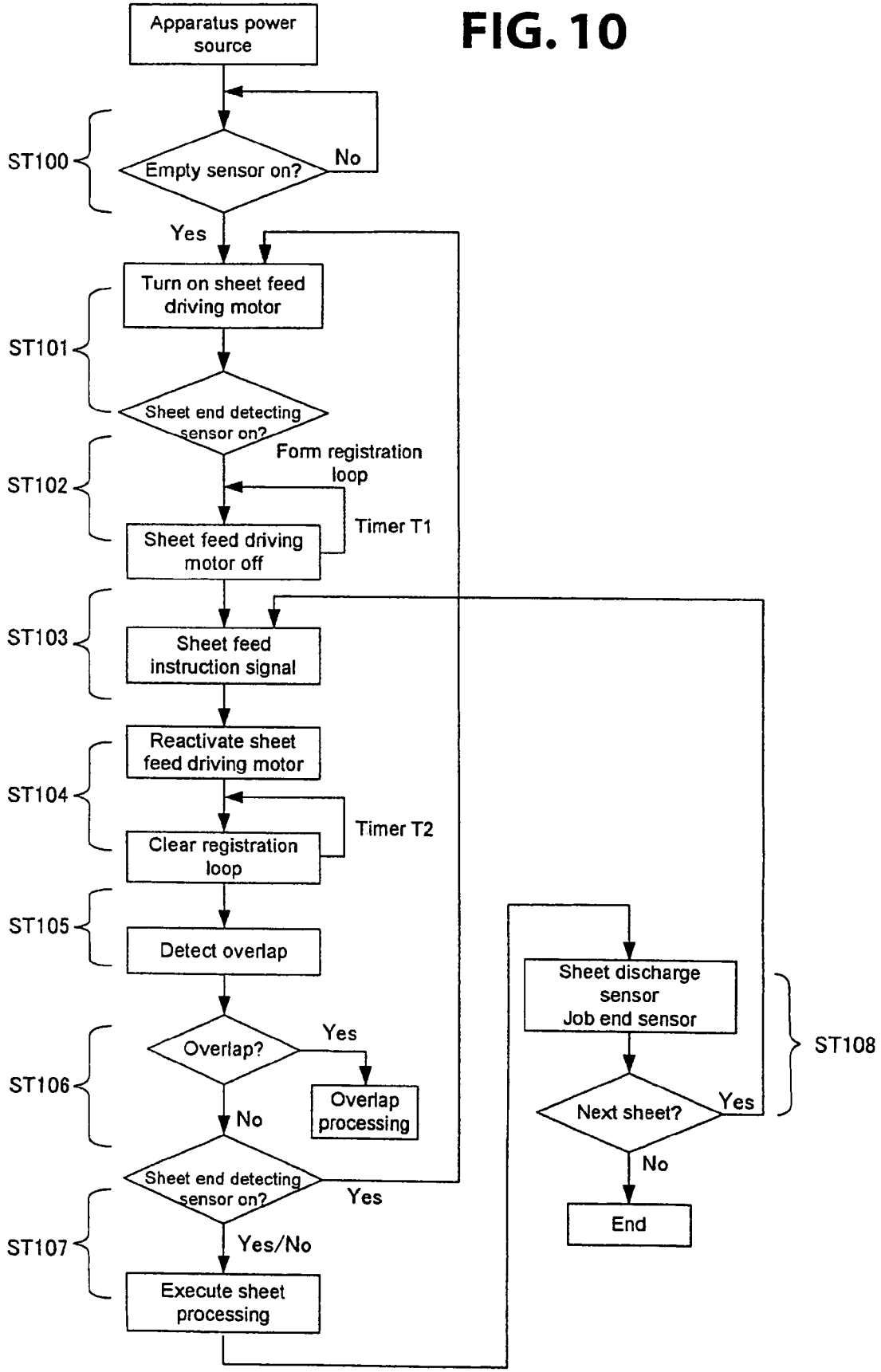
FIG. 10
Apparatus power source
ST100
Empty sensor on?
No
Yes
Turn on sheet feed driving motor
ST101
Sheet end detecting sensor on?
Form registration loop
ST102
Timer T1
Sheet feed driving motor off
ST103
Sheet feed instruction signal
Reactivate sheet feed driving motor
ST104
Timer T2
Clear registration loop
ST105
Detect overlap
ST106
Overlap?
Yes
Overlap processing
No
Sheet end detecting sensor on?
Yes
ST107
Yes/No
Execute sheet processing
Sheet discharge sensor
Job end sensor
ST108
Next sheet?
Yes
No
End

SHEET SUPPLYING DEVICE, IMAGE READING APPARATUS HAVING THE SAME AND METHOD OF DETECTING OVERLAPPING SHEETS

BACKGROUND OF THE INVENTION AND RELATED ART STATEMENT

The present invention relates to a sheet supplying device for sequentially separating sheets on a stacker and feeding a sheet to a processing platen for reading or printing an image, and a method of detecting overlapping of a plurality of sheets while the sheets are being fed.

A sheet supplying device sequentially supplies sheets stacked on a stacker to a processing platen of a device such as a printer, a copier, or a scanner. An image reading apparatus such as a scanner feeds documents on a stacker to a platen one by one, so that a photoelectric converting device reads an image on the document.

When such a device separates sheets on a stacker one by one and supplies the sheet to the processing platen, if a plurality of sheets (documents) is overlapped and fed (double feed), an erroneous processing may be executed at the processing platen. Accordingly, it is necessary to accurately separate the sheets into a single sheet and detect the double feed of the sheets before the sheet reaches the processing platen, so that the processing is stopped or processing data such as reading information is discarded not to be sent to a processing device such as a printer.

A conventional method of detecting the double feed of the sheets includes an ultrasonic sensor or a photo-sensor for detecting attenuation in an ultrasonic wave or an intensity of light passing through the sheet, thereby determining whether there is a single sheet.

Japanese Patent Publication (Kokai) No. 10-257595 discloses an ultrasonic sensor for detecting a sheet. The ultrasonic sensor includes a piezoelectric oscillation plate such as piezoelectric ceramic at a wave transmission side. A pulse voltage with a predetermined frequency is applied to the piezoelectric oscillation plate to generate oscillation, thereby transmitting ultrasonic waves. A similar oscillation plate is provided at a wave reception side for receiving the ultrasonic waves and converting to an electrical signal. Electric energy is compared with a reference value, thereby determining a single sheet or several sheets.

Japanese Utility Model Publication (Kokai) No. 06-49567 proposes a structure in which a wave transmission element and a wave reception element are arranged opposite to each other between a downstream roller and an upstream roller arranged with a predetermined distance in between, thereby making it possible to detect the double feed while the sheet is in a stable condition. More specifically, with such a structure, the double feed is detected while the downstream and upstream rollers nip the sheet in a straight position during transportation. Accordingly, it is possible to accurately detect the double feed since a leading edge or a trailing edge of the sheet is not curved or does not flip vertically.

When the ultrasonic sensor or optical sensor is used to detect the overlapping of the sheets, if the sheets have different quality, a thickness, or a size, it is difficult to accurately determine whether one or more sheets are being fed at a time. That is, when several sheets contact tightly with one another due to humidity or other environmental factors, it is difficult to determine between a single sheet having a large thickness and overlapped several sheets. When sheets with various sizes are overlapped and shifted in a longitudinal direction, it is difficult to determine between a single sheet having a large size and several sheets overlapped in the longitudinal direction. Moreover, when the sheets are flapped in a vertical direction at a position of the sensor, a transmitted quantity of sound wave or light varies, thereby making it difficult to accurately determine the double feed.

Japanese Utility Model Publication (Kokai) No. 6-49567 has proposed that the overlapping of the sheets is detected while the pair of the rollers supports the sheets. However, it is still difficult to detect the double feed when the sheets tightly contact with one another. Further, when the double feed is detected over a predetermined length to determine that the sheets are shifted in the longitudinal direction, the trailing edge of the sheets flaps upon leaving from the roller, thereby causing a misdetection.

In view of the problems described above, an object of the present invention is to provide a sheet supplying device that can accurately detect the overlapping of sheets even when the sheets tightly contact with one another or are shifted in the longitudinal direction thereof.

Another object of the present invention is to provide an image reading apparatus and a method of accurately detecting the overlapping of original documents while the sheets are fed from a stacker to a reading platen.

Further objects and advantages of the invention will be apparent from the following description of the invention.

SUMMARY OF THE INVENTION

To accomplish the objects described above, according to the present invention, a sheet supplying device comprises a stacker for placing documents (sheets) toward a processing position such as an image reading platen, and a sheet conveying guide for guiding the sheet from the stacker to the processing position. The stacker is provided with a delivery device for separating the sheet from others and feeding the sheet. The delivery device is formed of, for example, a sheet feeding roller contacting the uppermost sheet on the stacker to convey the sheet toward the processing position, and a friction pad contacting the roller with pressure. A register device such as a pair of pressure contact rollers is placed in the sheet conveying guide for temporarily holding the sheets fed by the delivery device. A sheet sensor is disposed at an upstream side of the register device for detecting the sheets. An overlap sensor is disposed at a downstream side of the register device for detecting overlapping of the sheets. The delivery device and the register device are controlled so that the delivery device feeds the sheet to the register roller and forms a loop at a leading edge of the sheet. A control circuit, for example, a CPU and a driver circuit, controls a driving device such as a motor connected to the delivery device and the register device in accordance with a signal from the sheet sensor for detecting the leading edge of the sheet, so that the delivery device feeds the sheet by a controlled amount.

An overlap determining device determines the overlapping of the sheets on the basis of a detection signal from the overlap sensor and a detection signal from the sheet sensor. When the CPU or the like receives an overlap signal and the sheet sensor detects the sheets, the overlap determining device determines that the overlap signal is valid. When the CPU or the like receives an overlap signal, and within a predetermined period of time after the sheet sensor detects the trailing edge of the sheet, the overlap determining device determines that the overlap signal is valid. A clocking device such as a timer sets a period of time from the sensor to immediately before the trailing edge of the sheet passes (leaves) the register device as the predetermined time.

The overlap sensor detects the sheets that are bent and loosened by the register device. When the overlapping sheets are bent, the sheets are released from a tight contact state, so that the overlapping is surely detected from an air layer between the sheets. The overlap determining device determines that the overlap signal from the sheet sensor is valid when the register device nips the trailing edge of the sheet. Accordingly, the overlap determining device does not determine the overlapping from the detection signal while the trailing edge of the sheet leaves the register device and is flapping.

According to the present invention, the conveyance control device may be provided with a first clocking device for forming the loop (hereinafter referred to as a register loop) in the sheet after the sheet sensor detects the leading edge of the sheet, and a second clocking device to be activated when the register device starts feeding the sheet to a platen. The second clocking device sets a time equal to or longer than that of the first clocking device. The overlap determining device is configured to determine the overlapping of the sheets on the basis of an output signal from the overlap sensor after the time set for the second clocking device. Accordingly, the register loop is removed, thereby making it possible to accurately determine the overlapping while the documents extend along a conveying path.

According to the present invention, the sheet conveying guide may include a bent guide member. The overlap sensor is disposed in a bent area of the guide member, so that the overlapping sheets are detected after being bent and loosened, thereby improving detection accuracy.

According to the present invention, a method of detecting overlapping sheets (documents) comprises a sheet delivering step of separating each sheet from others on a stacker and delivering the sheet; a loop forming step of abutting the document against a conveying roller to bend the document in a loop form; a document feeding step of extending the document bent by the conveying roller and feeding the extended document to the platen; a conveyance status detecting step of detecting the document on an upstream side of the conveying roller and detecting the overlapping on a downstream side of the conveying roller during the document feeding step; and an overlap determining step of determining the overlapping on the basis of an output signal indicating the overlapping and an output signal indicating the document obtained in the conveyance status detecting step.

In the present invention, the register device bends the sheets delivered from the stacker in a loop form, and the downstream overlap sensor detects the overlapping of the sheets, thereby accurately detecting the overlapping. In particular, when an ultrasonic wave sensor is used as an overlap sensor, tightly contacting sheets are bent so as to form air layers between the sheets. Accordingly, it is possible to easily determine whether a thick sheet or several overlapping sheets. Further, the sheet sensor disposed between the stacker and the register device detects the leading edge of the sheet to regulate the loop of the sheet. The sheet sensor also detects the trailing edge of the sheet to determine whether an output signal from the overlap sensor indicates that the register device is holding the sheet or that the sheet leaves the register device and is flapping, thereby making it possible to accurately detect the overlapping.

Accordingly, it is possible to accurately determine the overlapping of the sheets regardless of whether the sheets tightly contacts with each other or are overlapped and shifted in the longitudinal direction. In particular, for an image reading apparatus, it is possible to handle various types of sheets having different quality, thickness, size, or the like.

BRIEF DESCRIPTION OF THE DRAWINGS

FIG. 4 is a flowchart showing a control of the sheet supplying device shown in FIG. 1;

FIG. 10 is a flowchart showing a control of the image forming apparatus shown in FIG. 7.

DETAILED DESCRIPTION OF PREFERRED EMBODIMENTS

Figure 1:
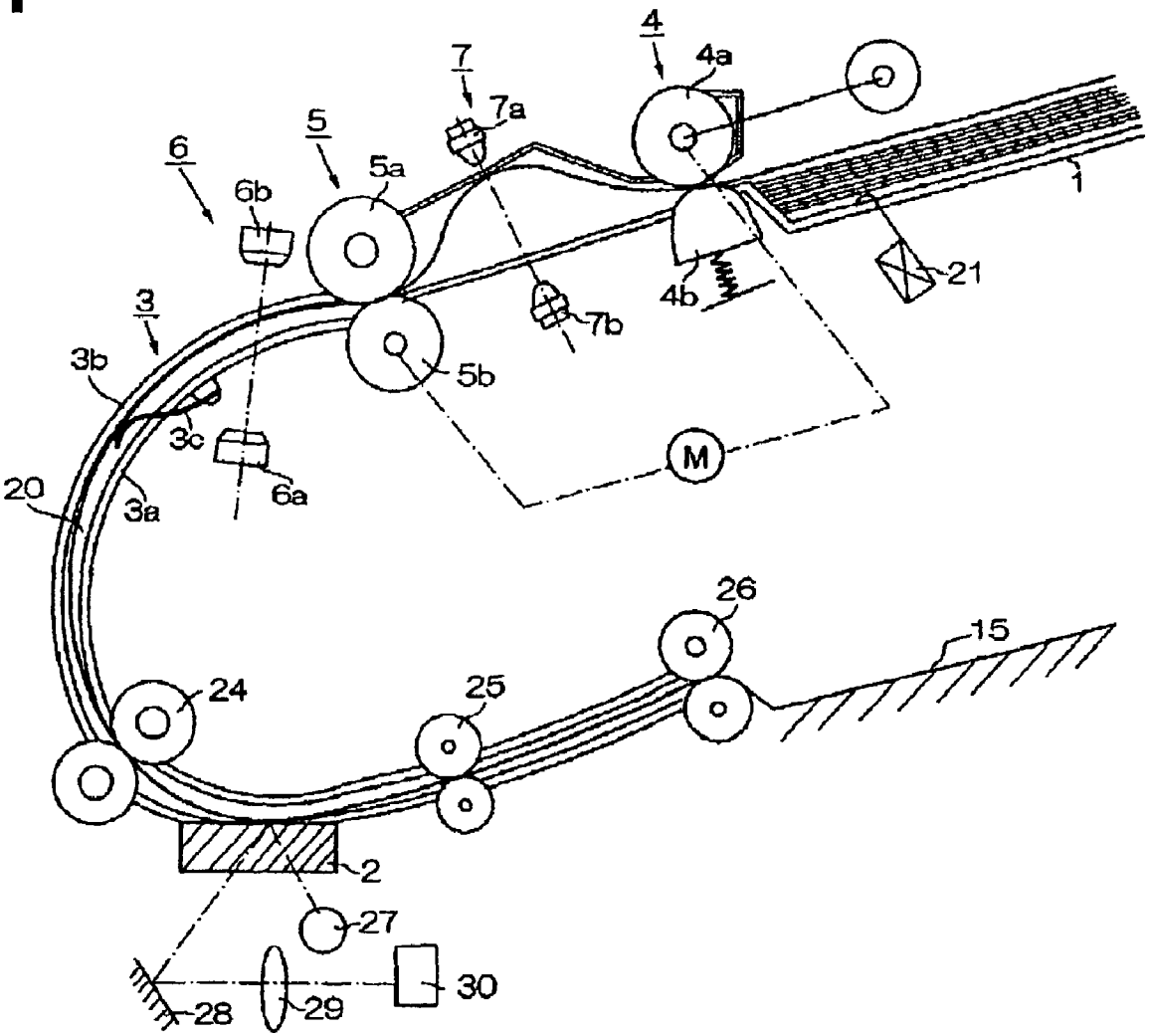
FIG. 1 is a view showing a sheet feeding mechanism section of a sheet supplying device according to an embodiment of the present invention.
Figure 2:
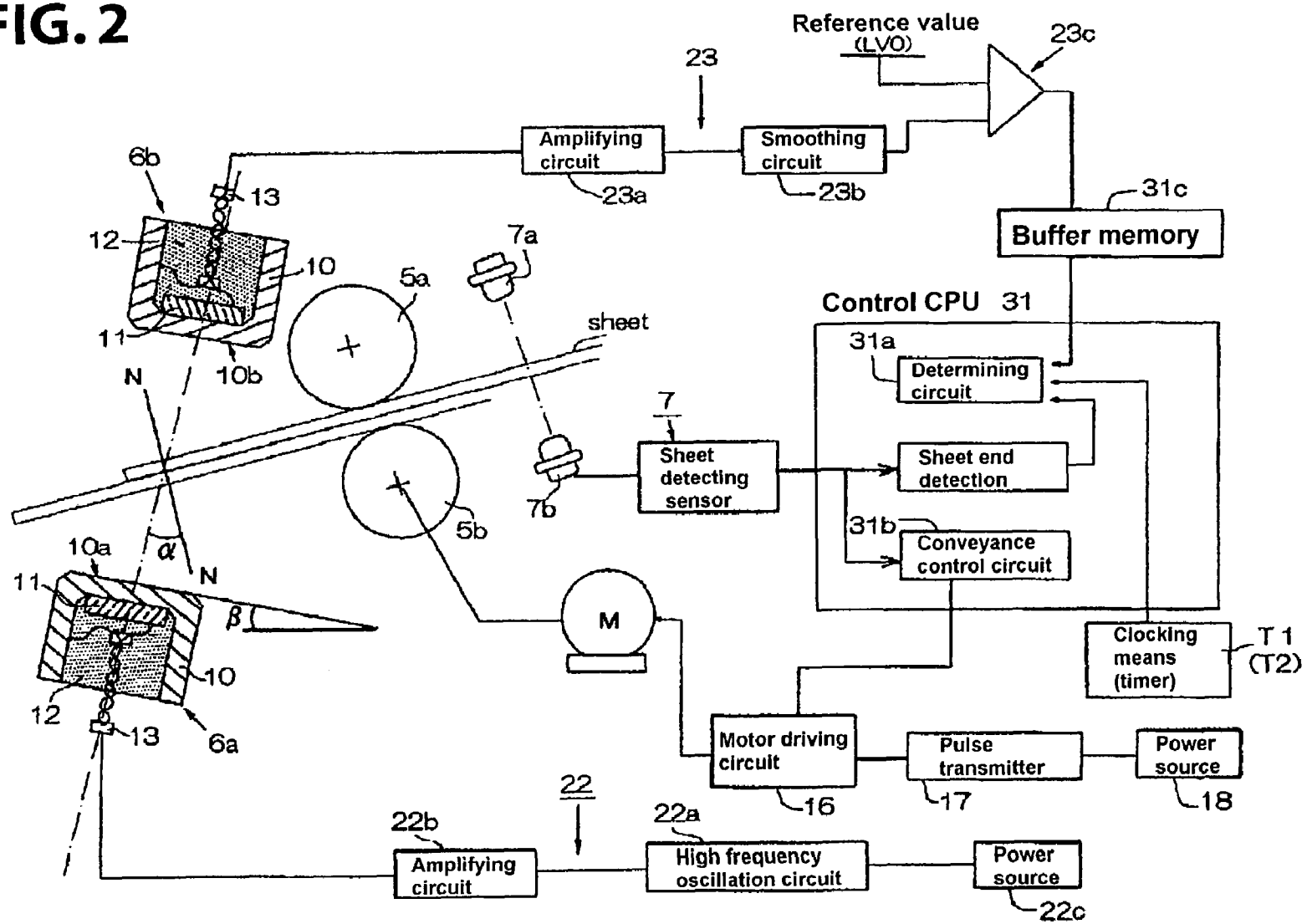
FIG. 2 is a diagram showing a structure of an overlap sensor in the sheet feeding mechanism section shown in FIG. 1.
Figure 3:
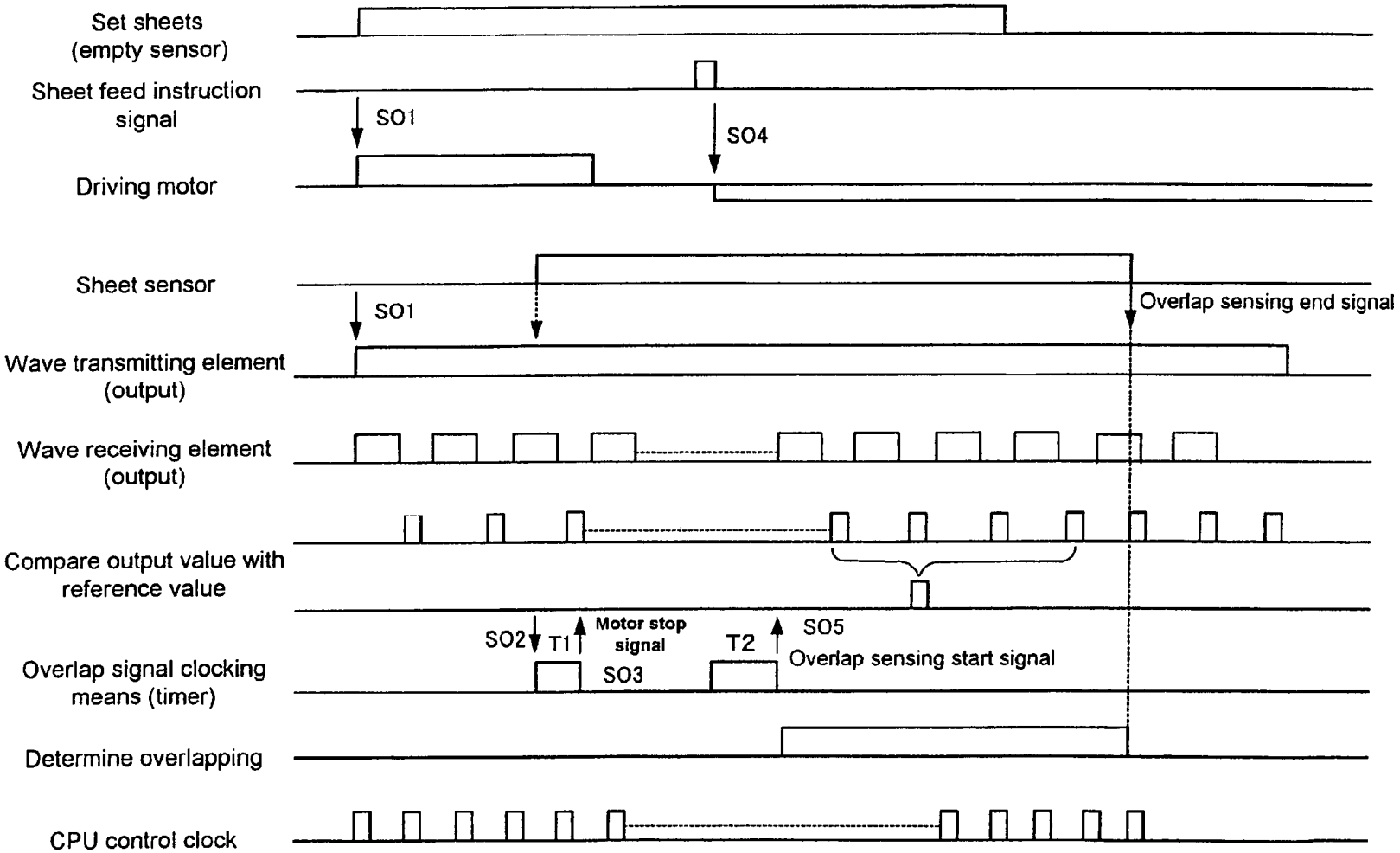
FIG. 3 is a timing chart showing control timings for the sheet supplying device shown in FIG. 1.
Figure 5A:
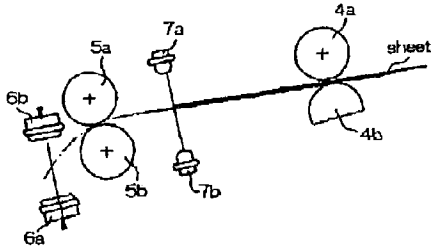
FIGS. 5(*a*) to 5(*e*) are views showing a process of delivering a sheet in the sheet supplying device shown in FIG. 1, wherein FIG. 5(*a*) shows a state immediately after the sheet is fed, FIG. 5(*b*) shows that the sheet is temporarily standing by, FIG. 5(*c*) shows a state immediately after the sheet is fed toward a platen, FIG. 5(*d*) shows that an overlap determination is started on a basis of an overlap detection signal, and FIG. 5(*e*) shows that the overlap determination is completed.
Figure 5B:
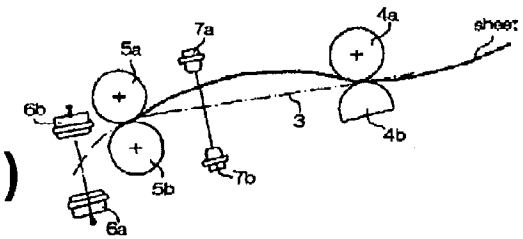
Figure 5C:
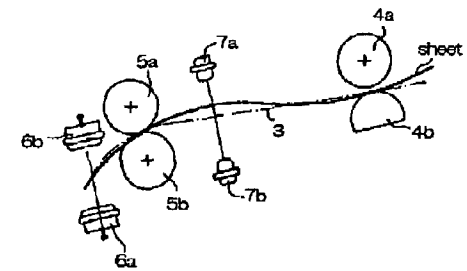
Figure 5D:
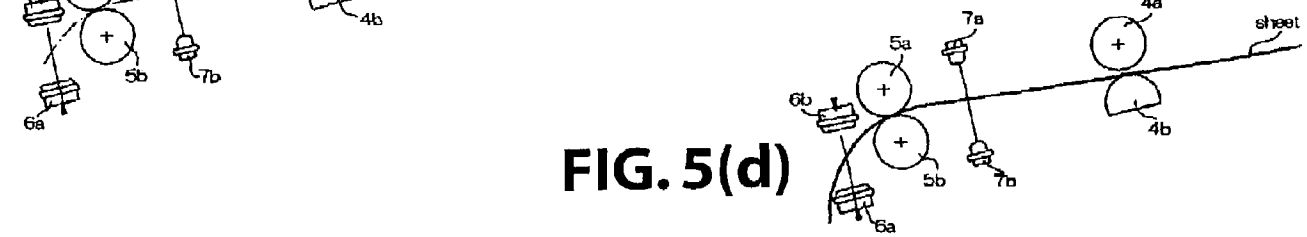
Figure 5E:
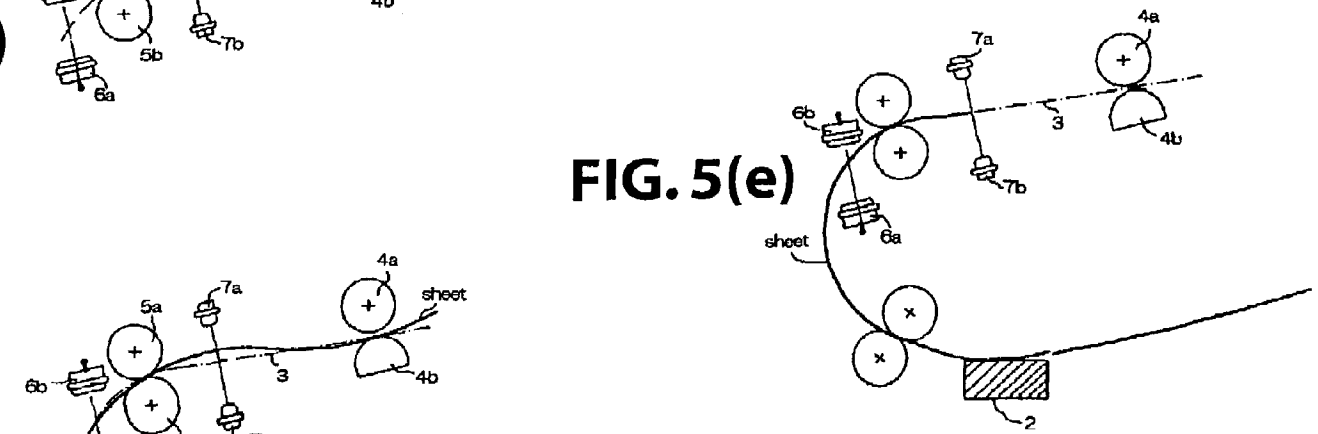
Figure 6A:
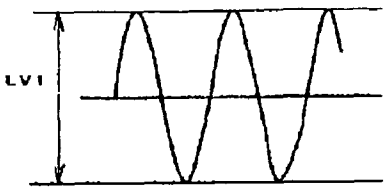
FIGS. 6(*a*) to 6(*e*) are charts showing waveforms of the ultrasonic sensor shown in FIG. 2.
Figure 6B:
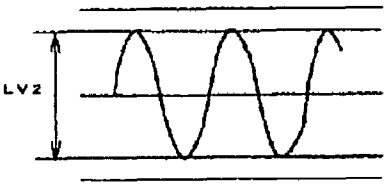
Figure 6C:
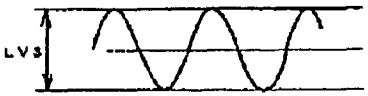
Figure 6D:
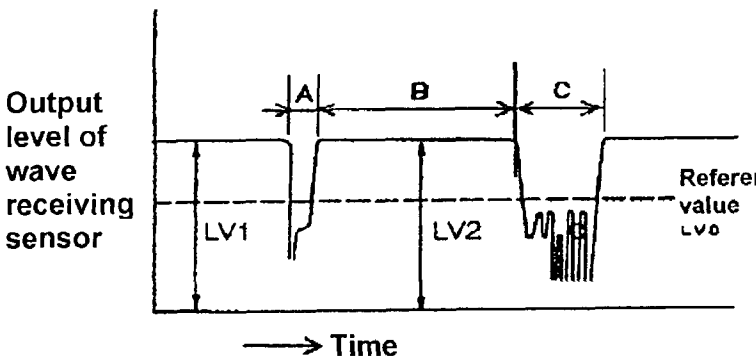
Figure 6E:
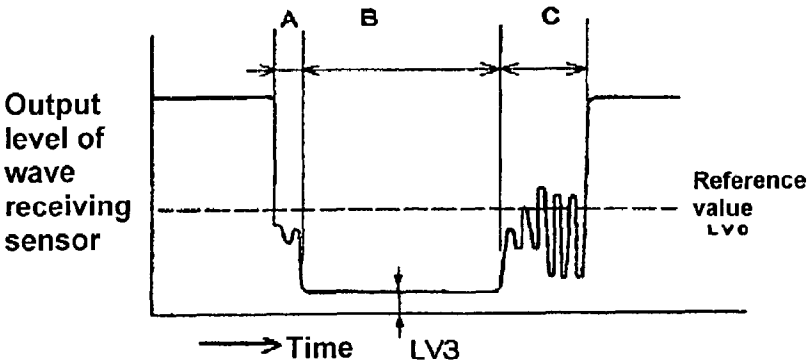

Hereunder, embodiments of the present invention will be described with reference to the accompanying drawings. FIG. 1 is a view showing a sheet feeding mechanism section of a sheet supplying device according to an embodiment of the present invention. FIG. 2 is a diagram showing a structure of an overlap sensor in the sheet feeding mechanism section shown in FIG. 1. FIG. 3 is a timing chart showing control timings for the sheet supplying device shown in FIG. 1. FIG. 4 is a flowchart showing a control of the sheet supplying device shown in FIG. 1

As shown in FIG. 1, a sheet feeding stacker 1 and a sheet discharging stacker 15 are arranged on a platen 2 of an image reading apparatus (described later) such as a scanner. A generally U-shaped conveying path 20 is formed of a sheet conveying guide 3 extending from the sheet feeding stacker 1 to the sheet discharging stacker 15. The sheet feeding stacker 1 is formed of a tray on which document sheets are stacked. The sheet feeding stacker 1 is provided with a separating device 4 for contacting and sequentially separating the uppermost sheet from other sheets and then feeding the sheet. The separating device 4 is formed of a separating roller 4*a* and a friction pad 4*b* pressingly contacting the separating roller 4*a*. The separating device 4 may be composed of a belt. Alternatively, the separating device 4 may comprise a pickup roller. A register device 5 is provided at a downstream side of the separating device 4. The register device 5 is formed of a pair of register rollers 5*a* and 5*b*. The register device 5 temporarily holds the sheet from the separating device 4, while bending a leading edge of the sheet in a loop form to correct a skew and loosen overlapping sheets.

A sheet sensor 7 is provided between the separating device 4 and the register device 5. The sheet sensor 7 has a light emitting element 7*a* and a light receiving element 7*b* formed of light emitting diodes or the like and arranged opposite each other with the sheet in between. The sensor 7 is not limited to a photo sensor, and may be formed of a combination of a micro switch and a lever contacting the sheet. An overlap sensor 6 (described later) is placed at a downstream side of the register device 5.

The separating device 4 and the register device 5 are connected to a driving device M and rotate in a sheet conveying direction. The driving device M is a stepping motor that can rotate forward and backward. The driving device M is connected to a motor driving circuit 16. The driving device M is supplied with power from a power source 18 via a pulse generator 17. A one-directional transmission clutch such as a one-way clutch is provided for transmitting an opposite rotating force to the separating device 4 and the register device 5. When the separating device 4 rotates to deliver the sheet from the stacker 1, the leading edge of the sheet abuts against the register device 5, so that the sheet is bent in a loop form. When the register device 5 is actuated to feed the sheet to the platen 2, the separating device 4 is stopped not to deliver a subsequent sheet.

An image reading mechanism is placed in the platen at a position where the sheet is to be processed. The image reading mechanism is formed of a light source 27 for irradiating the sheet on the platen 2; a lens for focusing light reflected from the light source 27; and a photoelectric converting device 38 such as a CCD (Charge Coupled Device) for electrically converting light from the lens 29. Reference numeral 28 in the figure denotes a polarizing mirror. The sheet conveying guide 3 is formed of guide members 3*a* and 3*b* arranged with a small space in between as a path for passing the sheets. The sheet conveying guide 3 forms a generally U-shaped conveying path 20 connected to the platen 2.

A pressing member 19 formed of an elastic film is provided on one of the guide members 3*a* at a downstream side immediately after the ultrasonic sensor 6 for deflecting the sheet toward the other of the guide members 3*b*. Accordingly, the sheet is pressed against the guide member 3*b* and stabilized, thereby preventing vertical flapping of the sheet and a misdetection. A feeding roller 24, an unloading roller 25, and a sheet discharging roller 26 are arranged on the conveying path 20. The feeding roller 24 is placed at an upstream side of the platen 2 and formed of a pair of rollers for supplying the sheet to the platen. Each of the unloading roller 25 and the sheet discharging roller 26 is formed of a roller pair for conveying the sheet from the platen to the sheet discharging tray 15.

The overlap sensor will be described with reference to FIG. 2. The overlap sensor is formed of an ultrasonic sensor 6. The ultrasonic sensor 6 is normally formed of a wave transmitting element 6*a* and a wave receiving element 6*b* having a same structure. Each element has a housing case 10 formed of metal or the like, and a piezoelectric vibrator 11 such as a piezoelectric ceramic plate is embedded in an elastic resin 12 in the housing case 10. Electrodes are formed on front and rear surfaces of the piezoelectric vibrator 11 with deposition. High-frequency power is supplied to the piezoelectric vibrator 11 through a lead 13. The piezoelectric vibrator 11 tightly contacts the housing case 10. The piezoelectric vibrator 11 vibrates at a particular frequency on the basis of a natural frequency common to the piezoelectric vibrator 11 and the housing case 10. A wave transmitting surface 10*a* forming a part of the case transmits an ultrasonic wave to an external apparatus. One of the leads 13 is grounded on the housing case 10.

When high-frequency power is supplied through the lead 13 in the wave transmitting element 6*a*, the piezoelectric vibrator 11 and the housing case 10 contacting the piezoelectric vibrator 11 vibrate at a predetermined frequency. An ultrasonic wave is emitted from the wave transmitting surface 10*a*. In the wave receiving element 6*b*, a wave receiving surface 10*b* and the piezoelectric vibrator 11 integrated with the wave receiving surface 10*b* are resonated with the ultrasonic wave. Accordingly, electricity is generated in the piezoelectric vibrator 11 and output to an external apparatus via the lead 13.

The ultrasonic sensor 6 described above is placed on the conveying path 20. The ultrasonic sensor 6 is connected to an oscillation circuit and an oscillation receiving circuit 23 as shown in FIG. 2. The oscillation circuit 22 is formed of a high-frequency oscillation circuit 22*a* and an amplification circuit 31*b*. The oscillation circuit 22 supplies a piezoelectric member 11 with a high-frequency voltage of a particular frequency from a power source 22*c*. The oscillation receiving circuit 23 is formed of an amplification circuit 23*a* and a smoothing circuit 23*b* formed of a transistor or the like. The high-frequency oscillation circuit 22*a* generates a high-frequency voltage of, for example, 30 to 400 KHz, and amplifies and applies the signal to the electrodes formed on the front and back surfaces of the piezoelectric vibrator 11 via the lead 13. The high-frequency oscillation circuit 22*a* thus excites the piezoelectric vibrator 11. The ultrasonic wave passes through the sheet, and excites the piezoelectric vibrator 11 of the wave receiving element. The ultrasonic wave is then output as an electric signal. The amplification circuit 23*a* amplifies the output signal from the wave receiving element 6*b*. The signal is rectified by the smoothing circuit 23*b* and smoothed by an integration circuit.

When power is supplied to the high-frequency oscillation circuit 22*a*, the ultrasonic wave of a particular frequency is excited in the piezoelectric vibrator 11 of the wave transmitting element 6*a*. The vibrator 11 emits the ultrasonic wave with a high frequency and specific amplitude (output level LV1) as shown in FIG. 6(*a*). The wave receiving element 6*b*, located opposite the wave transmitting element 6*a*, receives the ultrasonic wave through the sheet. The piezoelectric member 11 of the wave receiving element 6*b* is resonated and outputs power generated as a result of the vibration. The ultrasonic wave passing through the sheet is attenuated differently between a case of one sheet shown in FIG. 6(B) (output level LV2) and a case of two sheets shown in FIG. 6(*c*) (output level LV3).

The amplification circuit 23*a* and the smoothing circuit 23*b* process electric energy output with waveforms shown in FIGS. 6(*b*) and 6(*c*). Specifically, electric energy with a vibration waveform output by the wave receiving element 6*b* is amplified and rectified. The smoothing circuit 23*b* converts the electric energy into a signal with an output level as shown in FIGS. 6(*d*) and 6(*e*).

FIG. 6(*d*) shows the level LV2 obtained when one sheet is conveyed. A part A indicates that the leading edge of the sheet from the register rollers 5*a* and 5*b* reaches the sensor 6 and a detected value is disturbed. This is because the sheet is bent in a loop form when delivered by the register roller 5, and the leading edge of the sheet flaps. A part B indicates that the sheet is nipped by the register roller 5 so as to extend along the sheet conveying guide 3 and a detected value is stable. A part C indicates that the trailing edge of the sheet leaves the register rollers 5*a* and 5*b* (passed through the rollers) and a detected value is disturbed. FIG. 6(*e*) indicates the output level LV3 obtained when two sheets are conveyed while overlapping. Parts A, B, and C indicate the above states.

When a reference value is set at a level LVO shown by a hidden line, in the case of one sheet shown in FIG. 6(*d*) and the case of two sheets shown in FIG. 6(*e*), a relationship LV1>LV2>LV0>LV3 is established at the stable part B. Accordingly, when a comparison circuit (means) 23*c* such as a comparator compares an output signal at the part B from the smoothing circuit 23*b* with the reference value (LV0), it is possible to determine the overlapping of the sheets.

When the reference value is determined, first, conditions such as a thickness, quality of the sheets, and a sheet conveying speed are determined according to an environment in which the device is used. Then, under these conditions, boundary values of the output levels of the wave receiving sensor in the cases of one sheet and two sheets are experimentally determined to be set as the reference value.

As described above, the reference values are determined in the cases of one sheet and two sheets. A plurality of reference values may be set for cases of one sheet, two sheets, and more sheets. Accordingly, when the output signals are compared with the reference values, it is possible to detect the number of the overlapping sheets. The high-frequency oscillation circuit 22*a* instantaneously applies a high-frequency voltage to the wave transmitting element 6*a* to generate a burst wave, or consecutively applies a high-frequency voltage to the wave transmitting element 6*a* to generate a standing wave. In this case, the output signal from the wave receiving element 6*b* may become unstable (vary depending on environmental conditions) due to the overlapping of the sheets. Accordingly, it is preferable that the burst wave is detected consecutively and repeatedly a number of times.

The wave transmitting element 6*a* and the wave receiving element 6*b* are arranged as described below.

(1) The wave transmitting element 6*a* and the wave receiving element 6*b* are arranged opposite each other so as to incline at a predetermined angle relative to a sheet traveling along the conveying guide 3. As shown in FIG. 2, the elements are inclined at an angle α relative to a line N-N that perpendicular to the conveying guide. In the figure, the angle α is set at 35to 45 degrees. Accordingly, when the ultrasonic wave oscillated by the wave transmitting element 6*a* is reflected from a surface of the sheet and returns to a surface (wave transmitting surface) of the wave transmitting element 6*a*, the ultrasonic wave does not interferes with the oscillation wave. Similar interference between the sheet surface and a wave receiving surface 10*a* of the wave receiving element 6*b* is avoided. The angle α may be set on the basis of a distance between the sheet and the wave transmitting (receiving) surface as well as an area of the transmitting (receiving) surface.

(2) In the direction of gravity, the wave transmitting element is placed below the conveying guide 3, and the wave receiving element is placed above the conveying guide 3. As previously described, the intensity (LV1) of vibration on the wave transmitting surface of the wave transmitting element 6*a* is greater that that of the wave receiving element 6*b*. Further, to determine a difference in the level of resonance (intensity of vibration) on the wave receiving surface between the case of one sheet and the case of two sheets, it is necessary to reduce an external effect on the wave receiving surface. The wave transmitting element 6*a* is disposed at a lower position and the wave receiving element 6*b* is disposed at an upper position in the direction of gravity, so that an adverse effect of paper dusts falling from the sheet conveying guide on the detection accuracy is reduced.

(3) The wave transmitting surface 10*a* of the wave transmitting element 6*a* located at a lower position is inclined at a predetermined angle (β) relative to the horizontal direction. The angle β is selected such that dusts fall from the surface naturally or in corporation with the ultrasonic vibration. In the figure, the angle β is set at 30 degrees, and is preferably closer to 90 degrees.

FIGS. 5(*a*) to 5(*e*) are views showing a process of delivering the sheet in the sheet supplying device shown in FIG. 1. FIG. 5(*a*) shows a state immediately after the sheet is fed; FIG. 5(*b*) shows that the sheet is temporarily standing by; FIG. 5(*c*) shows a state immediately after the sheet is fed toward a platen; FIG. 5(*d*) shows that an overlap determination is started on a basis of an overlap detection signal; and FIG. 5(*e*) shows that the overlap determination is completed. An operation of the sheet supplying device will be described in accordance with a flowchart.

The sheet feeding stacker 1 is provided with an empty sensor 21 that detects the sheets placed on the stacker. When the device is powered on, a control CPU 31 uses the empty sensor 21 to detect the sheets are on the stacker 1. The driving motor M rotates in a forward direction (FIG. 4, ST01) upon a signal (FIG. 3, S01) indicating that the empty sensor 21 detects the sheets. The driving motor M rotates the separating roller 4*a* clockwise in FIG. 1, while the register roller 5*a* remains stopped. The separating roller 4*a* feeds the sheets on the stacker 1 to the left side in FIG. 1. The sheet passes through the sheet sensor 7 to the register roller 5*a*.

Upon detecting the leading edge of the sheet in the state shown in FIG. 5(*a*), the sheet sensor provides a detection signal S02 to activate a timer T1, i.e., the first clocking device. The timer T1 sends a stop signal S03 to stop the driving motor M after a set time (see FIG. 4, ST02). During the set time, the separating roller 4*a* rotates, so that the leading edge of the sheet reaches the register roller 5*a* and is then bent to form a predetermined loop as shown in FIG. 5(*b*). The timer T1 counts, for example, a reference clock of the CPU 31 to determine the set time. The set time is obtained from a time for forming the predetermined loop according to a specification of the device. The conveyance control circuit 31*b* of the control CPU 31 determines whether the leading edge of the sheet arrives, and the sheet sensor 7 sends a stop signal S03.

When a main body processing apparatus such as an image reading apparatus sends a sheet feed instruction signal S04, the driving motor M is driven backward to rotate the register roller 5*a* to feed the sheet to the platen 2. At the same time, in response to the sheet feed instruction signal S04, the control circuit 31*b* activates a timer T2 that is the second clocking device and turns on the oscillation circuit 22 of the ultrasonic sensor 6 (FIG. 4, ST03). A set time for the timer T2 is equal to or longer than that for the first clocking device T1. After the set time for the timer T2, the control circuit 31*b* provides an overlap detection start signal (S05) (FIG. 4, ST04). At this time, the sheet is transferred to the platen along the conveying guide 3 in a linear posture as shown in FIG. 5(*d*).

The clocking device (T2) is formed of a delay circuit for counting, for example, a reference clock of the control CPU 31. The control circuit 31*b* receives a signal indicating that the empty sheet sensor 21 detects the sheets, and supplies power to the oscillation circuit. The wave transmitting element 6*a* of the ultrasonic sensor 6 generates the ultrasonic wave with a predetermined frequency. The wave receiving element 6*b* receives the ultrasonic wave passing through the sheet. The wave receiving element 6*b* then provides an output corresponding to a condition of the sheet. The comparison circuit 13*c* then compares the reference value with the output processed at the amplification circuit 13*a* and the smoothing circuit 23*b*. A result of the comparison is stored in a buffer memory 31*c* and transferred to a determining circuit 31*a*.

The reverse rotation of the driving motor rotates the register roller 5*a* clockwise to feed the sheet to the processing platen 2. At this time, the separating roller 4*a* remains stopped. The loop in the leading edge of the sheet is removed, and the sheet is supported by the separating roller 4*a* and the register roller 5*a*. The timer T2 provides an overlap detection start signal (S05). Each of the timers T1 and T2 is formed of a delay circuit that uses a counter to count the reference clock in the control circuit 31.

In the overlap detection carried out by the determining circuit of the control CPU, an output signal from the wave receiving element 6*b* is divided into pieces corresponding to a predetermined time, for example, 1 millisecond. The divided signal is then compared with the reference value, and the buffer memory 23 sends a result of the comparison to the determining circuit (see FIG. 2). When the timer T2 is up, the control CPU 31 receives an overlap detection start signal S04 to clear the data stored in the buffer memory 31*c*. While the sheet is transferred, an output signal from the wave receiving element 6*b* sequentially carries the comparison data from the comparison circuit 23*c* to the memory 31*c*. The determining circuit 31*a* of the control CPU 31 retrieves the comparison data to monitor whether the overlapping of the sheets occurs (FIG. 4, ST05)

When the output level of the comparison data from the comparison circuit 23*c* is smaller than that of the reference value, that is, when the output level of the wave receiving element 6*b* is smaller than that of the reference value, the determining circuit 31*a* of the control CPU determines the overlapping in accordance with the following step (1) as ST6 shown in FIG. 4. On the other hand, when the output level of the comparison data is greater than that of the reference value, the determining circuit 31*a* determines no overlapping. The determining circuit 31*a* executes processing in accordance with the following step (2) as ST07 shown in FIG. 4.

(1) When the comparison data indicates the overlapping, the determining circuit 31*a* determines the comparison data to be valid and executes overlap processing when a status signal from the sheet sensor 7 indicates presence of the sheets (FIG. 4, ST08). The overlap processing provides a trouble signal to a main body apparatus such as an image reading apparatus or an image forming apparatus to stop the operation of the main body apparatus. At the same time, a control panel provides an indication of the overlapping to warn a user. Alternatively, the overlap processing may store a order of pages for the overlapping sheets and continue to perform the next sheet processing operation. Then, once the whole processing is finished, the stored information may be displayed so that the user can execute the processing again on the basis of the information displayed to make required corrections.

(2) When the comparison data indicates that the overlapping does not occur, the determining circuit 31*a* executes the sheet processing or continues the sheet processing being executed when the status signal from the sheet sensor 7 indicates absence of the sheets. In the case of the presence of the sheets, while the sheet processing is executed or the sheet processing is continued, the determining circuit 31*a* loads the next comparison data to monitor the data overlapping (FIG. 4, ST07). After the sheet processing, the determining circuit 31*a* determines whether the next sheet is present on the sheet feeding tray on the basis of a signal from the empty sensor 21 (FIG. 4, ST09). When the next sheet is present, the process shifts to step ST03 to process the next sheet document in the same manner. In this case, the next sheet is fed to the register roller. When the next sheet is not present on the sheet feeding tray, the determining circuit determines that the job is finished and stops the device.

The status signal from the sheet sensor 7 may determine the presence of the sheets based on whether a predetermined time elapses since the trailing edge of the sheet passes the sensor 7. In other words, the timer may be started in response to a change in the status signal from the sensor 7 from the presence to the absence of the sheets. Then, whether the process is to shift to step ST06 or ST08 may be determined on the basis of whether an expected time elapses for the trailing edge of the sheet to pass through (leave) the register rollers 5*a* and 5*b*. The comparison data indicating the overlapping is determined to be valid depending on whether the register roller nips and supports the trailing edge of the sheets, thereby determining whether to shift to the overlap processing or sheet processing.

A method of detecting the overlapping will be explained according to an embodiment of the present invention.

[Sheet Delivering Step]

A step of separating the sheet from others on the stacker and delivering the sheet includes placing a series of sheets on the sheet feeding tray, separating each sheet from the others, and delivering the sheet. In the above device, the conveyance control circuit 31*b* uses the separating roller 4*a* and the friction pad 4*b* to separate each sheet from the others on the sheet feeding tray and feed it, and is formed of a program of the control CPU.

[Loop Forming Step]

The register device constitutes a loop forming step of abutting the document delivered in the above step against the conveying roller to bend the document in a loop form. The above device controls the separating roller 4*a* and the register rollers 5*a* and 5*b*, so that the separating roller 4*a* delivers the sheet to the register rollers 5*a* and 5*b* to bend the leading edge of the sheet.

[Document Feeding Step]

In a document feeding step of using the conveying roller formed of the register roller to extend the bent document sheet and then feed it to the platen, the driving motor rotates the register rollers 5*a* and 5*b*.

[Conveyance Status Detecting Step]

In a conveyance status detecting step, the sheets are detected on an upstream side of the conveying roller means, and the overlapping status is detected on a downstream side of the conveying roller during the document feeding step of feeding the sheet to the platen. In the above device, the photo sensor is provided at an upstream side of the register roller 5*a* to detect the sheets. The ultrasonic sensor is placed at a downstream side of the register roller to detect the overlapping status.

[Overlap Determining Step]

In an overlap determining step, the overlapping is determined on the basis of the results of detection of the document overlapping status and the sheets carried out in the conveyance status detecting step. The above device determines the overlapping on the basis of the overlap sensing signal from the ultrasonic sensor and the sheet presence signal from the sheet sensor.

Figure 7:
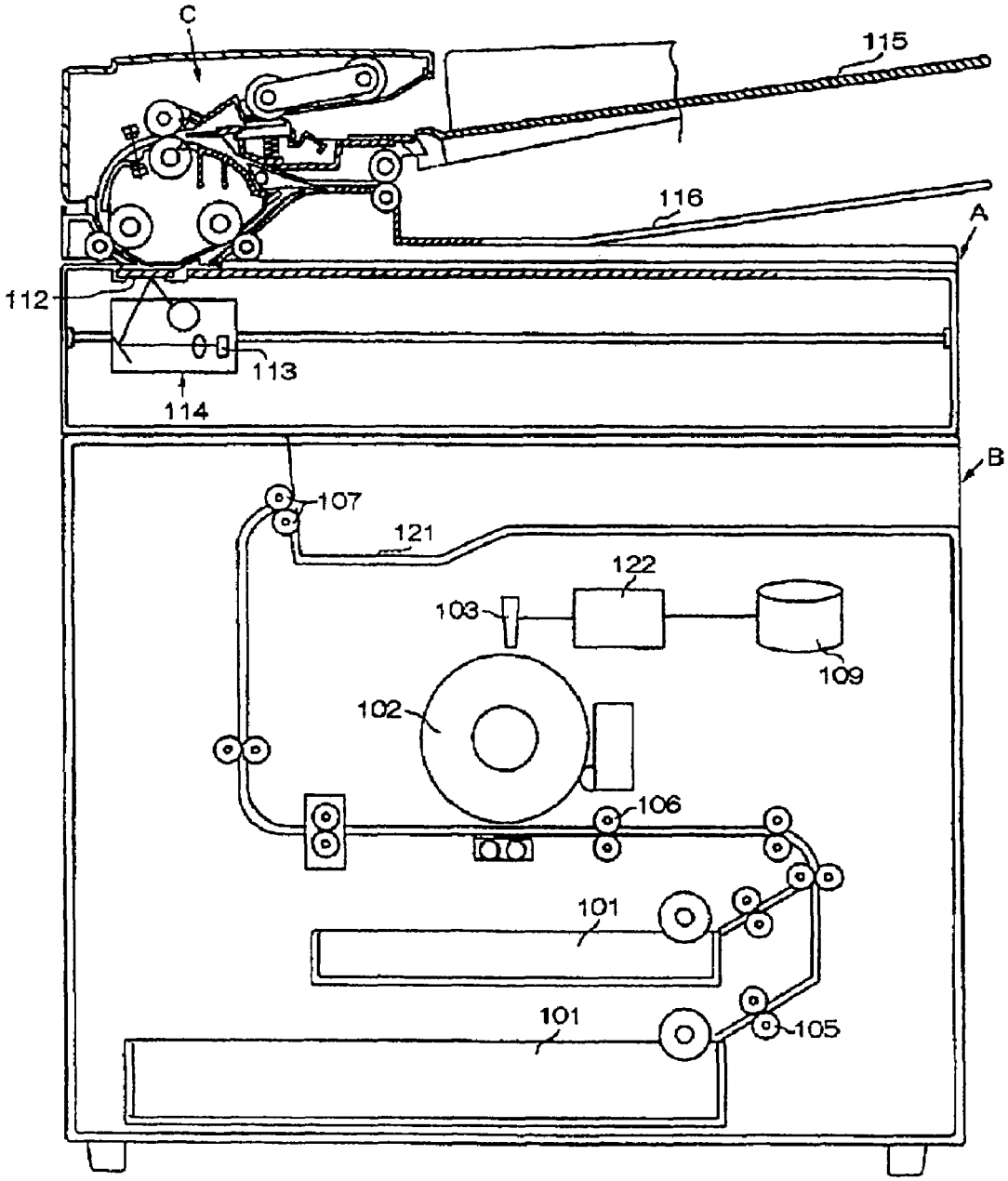
FIG. 7 is a diagram showing an image reading apparatus according to an embodiment of the present invention and an image forming apparatus having the image reading apparatus as a unit.
Figure 8:
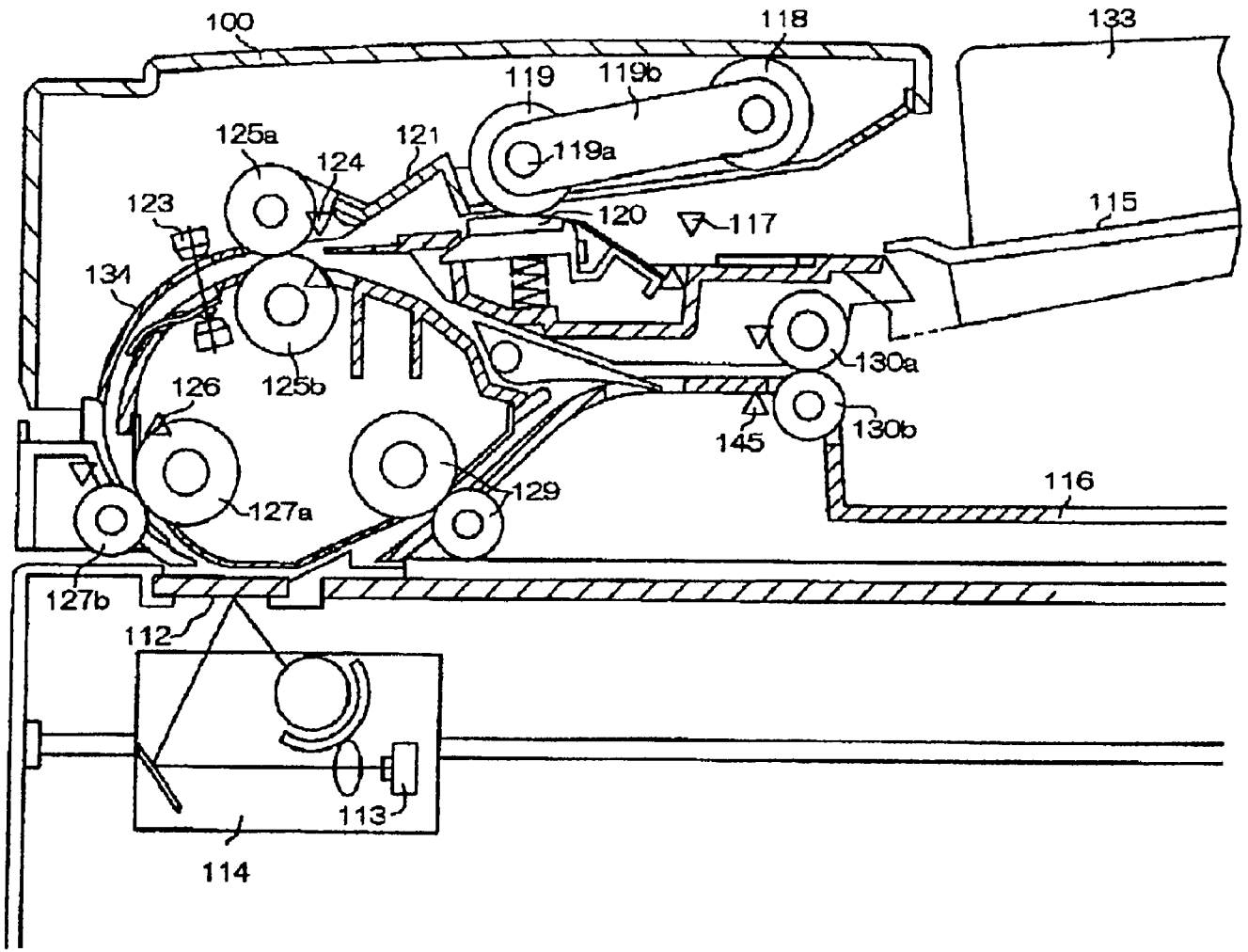
FIG. 8 is a diagram showing a sheet supplying section of the image forming apparatus shown in FIG. 7.

An image reading apparatus according to an embodiment of the present invention will be explained next. FIG. 7 shows an image reading device A and an image forming apparatus B having the image reading device A as a unit. FIG. 8 shows a sheet supplying section of the image reading apparatus A. The image forming apparatus B having the image reading device A (described below) has a print drum 102; a sheet feeding cassette 101 for supplying a sheet to the print drum 102; a developing device 108 for developing an image on the print drum 102 with toner ink; and a fixing device 104. These components are contained in a casing 100. Reference numeral 103 denotes a print head that uses a laser or the like to form a latent image on the print drum 192. The conveying roller 105 conveys the sheet from the sheet feeding cassette 101 to the print drum 102. An image formed by the print head 103 is transferred to the print drum 102. The fixing device 104 then fixes the image.

The image forming apparatus B is widely known as a printer and formed of a sheet feeding section, a printing section, and a discharged sheet housing section. The functional parts are not limited to those described above, and may have various functions such as ink jet printing and silk screen printing. The print head 103 is electrically connected to a storage device 109 such as a hard disk for storing image data and a data management control circuit 122 for sequentially transferring the image data to the print head. The image reading device A is mounted on an upper part of the image forming apparatus B as a unit.

In the image reading apparatus A, a platen 112 is mounted in the casing 110. An optical mechanism 114 and a photoelectric converting element 113 are arranged in the casing 110 to read a document sheet via the platen. A CCD or the like is widely known as the photoelectric converting element 113.

A sheet supplying device C shown in FIG. 8 is installed in the platen 112. In the sheet supplying device C, a sheet feeding stacker 115 and a sheet discharging stacker 116 are provided above the platen 112 in parallel in the vertical direction. The sheet from the sheet feeding stacker 115 is guided along a U-shaped conveying path to the sheet discharging stacker 116 via the platen 112. An empty sensor 117 and a size sensor (not shown) are arranged on the sheet feeding stacker 115, and the empty sensor 117 detects the sheets placed on the stacker 115. Reference numeral 133 denotes a side guide that regulates the side edges of the sheet.

A separating roller 119 and a fixed roller 120 are arranged at an upstream side of the sheet feeding stacker 115, and the fixed roller 120 pressingly contacts the separating roller 119. A kick roller 118 is attached to a bracket 119*b* mounted to a rotating shaft 119*a* of the separating roller 119. When the rotating shaft 119*a* rotates clockwise, the kick roller 118 lowers onto the sheet feeding stacker 115. When the rotating shaft 119*a* rotates counterclockwise, the kick roller 118 elevates to a state shown in the figure (described in detail with reference to FIG. 10). A sheet sensor is placed at a downstream side of the separating roller 119 for detecting the leading and trailing edges of the sheet. The conveying path 134 is provided with register rollers 125*a* and 125*b*, feeding rollers 127*a* and 127*b*, an unloading roller 129, and a sheet discharging roller 116 in this order. The sheet is conveyed from the sheet feeding stacker 115 to the sheet discharging stacker 116.

An overlap sensor 124 is placed at a downstream side of the register roller 125 and formed of a pair of ultrasonic sensors. In each ultrasonic sensor, a wave transmitting element and a wave receiving element are arranged and configured as described above (see FIG. 1). Reference numeral 128 denotes a pair of guide members 128*a* and 128*b* for guiding the sheet to the platen 112 while maintaining the sheet in a U shape. The guide member 128*a* is provided with a pressing member 128*c* for deflecting the sheet to the opposite guide member 128*b*. The pressing member is formed of an elastic resin film. A lead sensor 126 is provided at a downstream side of the pressing member for detecting the leading edge of the sheet. Reference numeral 131 denotes a circulating path through which a sheet from the platen 112 is fed to the register rollers 125*a* and 125*b* through a path switching gate 131*a*.

Figure 9A:
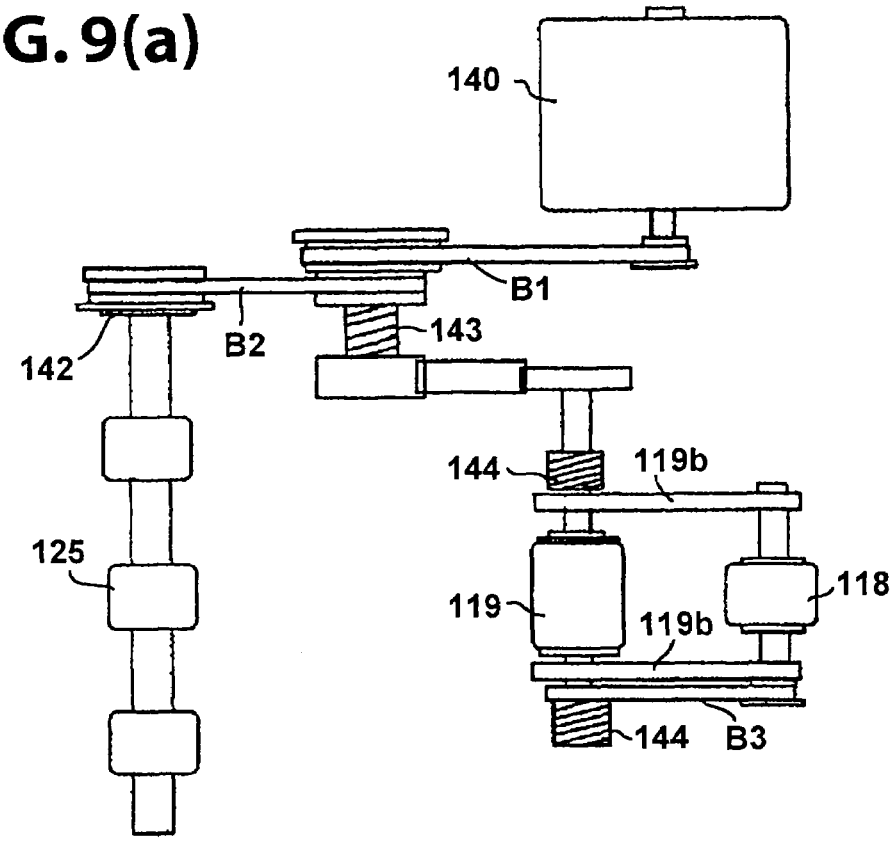
FIGS. 9(*a*) and 9(*b*) are views showing driving mechanisms of the image forming apparatus shown in FIG. 8.
Figure 9B:
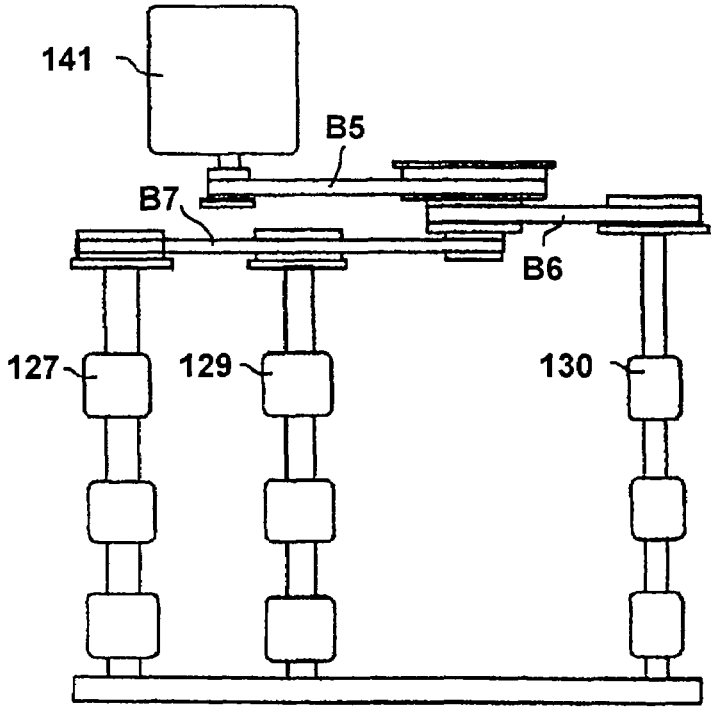
Figure 11A:
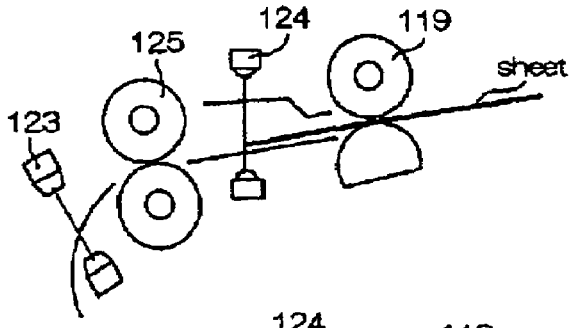
FIGS. 11(*a*) to 11(*e*) are views showing an operation of supplying a sheet in the image forming apparatus shown in FIG. 7.
Figure 11B:
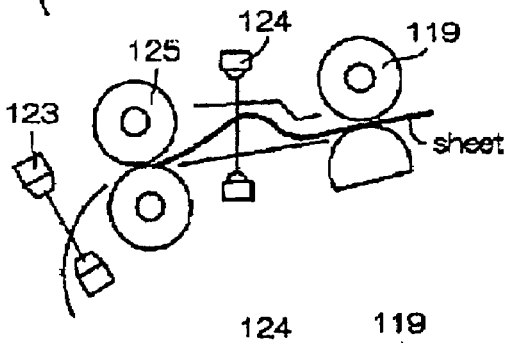
Figure 11C:
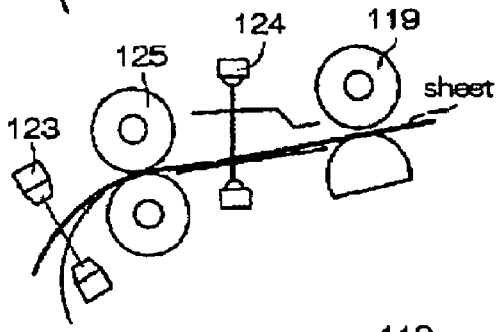
Figure 11D:
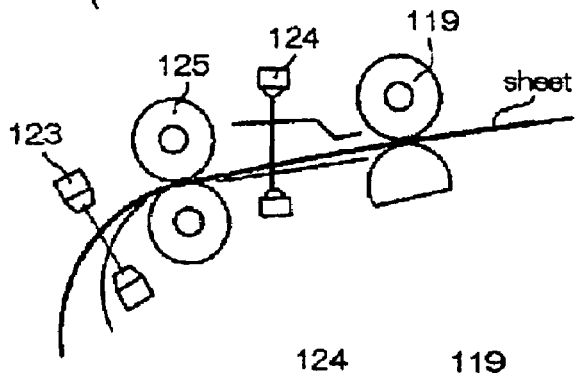
Figure 11E:
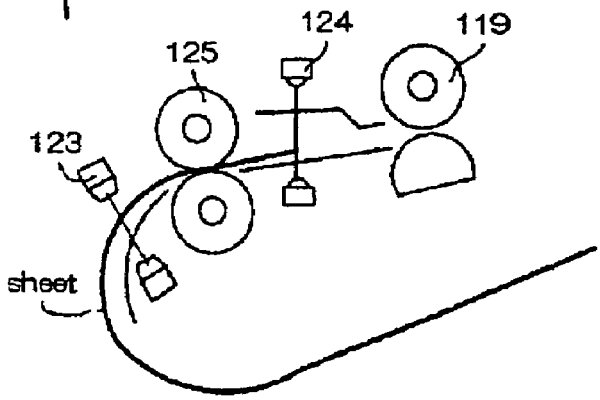

A driving mechanism of the conveying rollers will be described next. FIG. 9(*a*) shows a driving mechanism for the separating roller 119 and register roller 125. A sheet feed driving motor 140 capable of rotating forward and backward drives the kick roller 118, the separating roller 119, and the register roller 125. FIG. 9(*b*) shows a conveyance driving motor 141 for the feeding roller 127, an unloading roller 129, and a sheet discharging roller 130 as well as a transmission mechanism for the conveyance driving motor 141. In FIG. 9(*a*), the sheet feed driving motor 140 rotates forward to drive the kick roller 118 and the separating roller 119. The sheet feed driving motor 140 rotates backward to drive the register roller 125. The sheet feed driving motor 140 controllably elevates and lowers the kick roller 118. The sheet feed driving motor 140 transmits rotations to the register roller 125 via belts B1 and B2 in only one direction through a one way clutch 142. The sheet feed driving motor 140 is also connected to a rotating shaft of the separating roller 119 through a one way clutch 143. The one way clutches 142 and 143 are set so that they transmit opposite driving forces.

A bracket 119*b* is supported on a rotating shaft of the separating roller 119 via a spring clutch 144. A belt B3 is used to transmit a driving force to the kick roller 118 attached to the bracket 119*b*. The sheet feed driving motor 140 rotates forward to drive the separating roller 119 and the kick roller 118. A spring of the spring clutch 144 is loosened to release the bracket 119*b*. The bracket 119*b* thus lowers from a withdrawn position where the bracket 119*b* is elevated. Consequently, the kick rocker 118 contacts the sheet on the stacker. The sheet feed driving motor 140 rotates backward to transmit a driving force to the register roller 125. The spring clutch 144 is contracted to elevate and return the bracket 119*b* to the withdrawn position in FIG. 8.

A conveying section driving motor 141 is connected to the feeding roller 127, unloading roller 129, and sheet discharging roller 130 as shown in FIG. 9(*b*). Even though the motor rotates forward and backward, the one-way clutch allows the feeding roller 127 and the unloading roller 129 to always rotate in only one direction. The sheet discharging roller 130 rotates forward and backward as the motor rotates forward and backward.

A sensor is placed on the conveying path 134 to detect the leading edge of the sheet. The sensor will be described below together with an operation thereof. A plurality of sensors (not shown) is arranged on the sheet feeding stacker 115 for detecting a specific size of the sheet. These sensors detect the size of the sheet to control the conveyance of the sheets. The empty sensor 117 is provided at a tip portion of the sheet feeding stacker 115 to detect the sheets on the stacker. The empty sensor 117 detects that the final sheet is fed to provide a signal to a processing apparatus such as the image reading apparatus A. An ultrasonic sensor 123 and a sheet end detecting sensor 124 are provided at a downstream side of the separating roller 119.

A lead sensor 126 is provided before the feeding roller 127 for notifying the image reading apparatus that the leading edge of the sheet arrives. The lead sensor 126 further determines a line on the sheet where reading or printing is to be started. When no sheet is detected even after a predetermined time since the feeding instruction signal is sent to the register roller 125, the lead sensor 126 determines that a jam occurs. The lead sensor 126 stops the driving motor and sends a warning signal. A sheet discharge sensor 145 is placed at a downstream side of the unloading roller 129 for detecting the leading and trailing edges of the sheet. The sheet discharge sensor 145 thus determines whether a jam occurs.

An operation of the above apparatus will be described. FIG. 10 shows a flowchart of the operation. An apparatus power source is turned on and the sheets are set (placed) on the sheet feeding stacker 115. The empty sensor 117 detects the sheets, and actuates the sheet feed driving motor 140 (ST100). The sheet feed driving motor 140 rotates the kick roller 118 and the separating roller 119 to separate one sheet from the others. The sheet is then fed to the conveying guide 128 between the separating roller 119 and the register roller 125. The sheet sensor 124 (referred to as the sensor 124 below) detects the leading edge of the sheet (ST101). A detection signal of the leading edge of the sheet operates the timer T1 (see FIG. 3) to stop the motor 140 after a predetermined time (ST102).

As shown in FIG. 11(*a*), the sensor 124 detects the leading edge of the sheet to operate the timer T1. As shown in FIG. 11(*b*), the leading edge of the sheet abuts against the register roller 125 and is thus bent in a loop form. In this state, the set time for the timer T1 is over and the motor 140 is stopped. When a control section of the image reading apparatus A provides the sheet feeding instruction signal, the motor is actuated again and rotates backward (ST103). The sheet feeing instruction signal operates the timer T2. The timer T2 (see FIG. 4) clears a register loop to allow the sheet to be conveyed linearly supported between the separating roller 119 and the register roller 125 (ST104) as shown in FIG. 11(*c*). The overlap detection start instruction signal is provided to determine the overlapping of the sheets as described above with reference to FIGS. 1 to 6.

As shown in FIG. 11(*e*), the ultrasonic sensor 123 detects the overlapping until the sensor 124 detects the trailing edge of the sheet (ST105). The sensor 124 detects the trailing edge of the sheet fed as described above (ST106). Before the trailing edge of the sheet is detected, the lead sensor 126 detects the leading edge of the sheet. The feeding roller 127 thus feeds the sheet to the platen 112. After the leading edge is detected by the lead sensor 126, when the sheet reaches the platen 112, the optical mechanism 114 and the photoelectric converting element 113 read the sheet to obtain an electric signal (ST107). After the reading process, the unloading roller 129 and the sheet discharging roller 130 discharge the sheet to the sheet discharging stacker 116. The sheet discharge sensor 145 detects that the sheet is discharged (ST108).

The disclosure to Japanese Patent Application No. 2003-428192, filed on Dec. 24, 2003, is incorporated in the application.

While the invention has been explained with reference to the specific embodiments of the invention, the explanation is illustrative and the invention is limited only by the appended claims.

What is claimed is:

1. A sheet supplying device comprising:

a stacker for placing sheets, a delivery device for separating the sheets on the stacker and feeding the sheets, a register device for temporarily holding a sheet from the delivery device, a sheet conveying guide for guiding the sheet from the register device to a processing position, a sheet sensor disposed between the delivery device and the register device for detecting the sheet, at least one driving device for driving the delivery device and the register device, a conveyance control device for controlling the driving device so that the delivery device and the register device form a loop in the sheet according to a signal from the sheet sensor when a leading edge thereof reaches the register device, an overlap sensor disposed between the register device and the processing position for detecting overlapping of the sheets, and an overlap determining device for determining the overlapping of the sheet according to signals from the sheet sensor and the overlap sensor, said overlap determining device obtaining an overlapping signal of the sheet at a position where the loop in the sheet is eliminated by the register device, and determining the overlapping signal as an effective signal when the overlapping signal is obtained within a predetermined time since the sheet sensor detects a rear edge of the sheet.

2. A sheet supplying device according to claim 1, wherein said conveyance control device has a first clocking device for stopping the delivery device after the sheet sensor detects the leading edge of the sheet, and a second clocking device for removing the loop after the register device is actuated, said overlap determining device determining the overlapping of the sheets according to the signals from the overlap sensor and the sheet sensor after a predetermined period of time by the second clocking device.

3. A sheet supplying device according to claim 2, wherein said overlap determining device determines the overlapping when the overlap sensor sends the signal and the sheet sensor detects the sheet after a predetermined period of time set by the second clocking device.

4. A sheet supplying device according to claim 2, wherein said overlap determining device determines the overlapping of the sheets according to respective signals from the overlap sensor, second clocking device and the sheet sensor.

5. A sheet supplying device according to claim 2, wherein said overlap sensor includes a wave transmitting element for generating an ultrasonic wave with a predetermined frequency, and a wave receiving element for receiving the ultrasonic wave from the wave transmitting element.

6. A sheet supplying device according to claim 5, wherein said overlap determining device determines the overlapping of the sheets according to a comparison result of an output signal from the wave receiving element with a reference value, an elapse of the predetermined period of time of the second clocking device, and a detection result of the sheet sensor.

7. A sheet supplying device according to claim 1, wherein said driving device includes a single reversible motor for driving the delivery device when rotating forward and for driving the register device when rotating backward, said conveyance control device switching a rotating direction of the single motor based on a detection signal of the leading edge of the sheet from the sheet sensor.

8. A sheet supplying device according to claim 1, wherein said sheet conveying guide includes a U-shaped conveying path extending from the register device to the processing position, said overlap sensor being disposed on the U-shaped conveying path.

9. A sheet supplying device according to claim 1, wherein said sheet conveying guide includes a pair of guide members facing each other and forming a sheet conveying path, at least one of said guide members having a pressing member for pressing the sheet toward the other of the guide members.

10. A sheet supplying device according to claim 1, further comprising a clock for counting said predetermined time since the sheet sensor detects the rear edge of the sheet, said sheet being gripped by the register device within said predetermined time.

11. An image reading apparatus comprising:

a platen having a photoelectric converting device for reading an image on a sheet, a stacker for placing the sheets, a delivery device for separating the sheets on the stacker and feeding the sheets, a register device for temporarily holding a sheet from the delivery device, a sheet conveying guide for guiding the sheet from the register device to the platen, a sheet sensor disposed between the delivery device and the register device for detecting the sheet, at least one driving device for driving the sheet feeding device and the register device, a conveyance control device for controlling the driving device, said conveyance control device controlling the delivery device and the register device so that a leading edge of the sheet abuts against the register device to form a loop therein and then the register device feeds the sheet to the platen, an overlap sensor disposed between the register device and the platen for detecting overlapping of the sheet, and an overlap determining device for determining the overlapping of the sheet according to signals from the overlap sensor and the sheet sensor, said overlap determining device obtaining an overlapping signal of the sheet at a position where the loop in the sheet is eliminated by the register device, and determining the overlapping signal as an effective signal when the overlapping signal is obtained within a predetermined time since the sheet sensor detects a rear edge of the sheet.

12. An image processing apparatus according to claim 11, wherein said conveyance control device includes a first clocking device for forming the loop when the sheet sensor detects the leading edge of the sheet, and a second clocking device for removing the loop after the register device is actuated, said overlap determining device determining the overlapping according to the signals from the overlap sensor and sheet sensor after a predetermined period of time set by the second clocking device.

13. An image processing apparatus according to claim 11, wherein said sheet conveying guide includes a pair of guide members facing each other and forming a sheet conveying path, at least one of said guide members having a pressing member for pressing the sheet toward the other of the guide members.

14. A sheet supplying device according to claim 11, further comprising a clock for counting said predetermined time since the sheet sensor detects the rear edge of the sheet, said sheet being gripped by the register device within said predetermined time.

15. A method of detecting overlapping of sheets while at least one conveying roller feeds a sheet from a stacker to a platen, comprising:

separating the sheets on the stacker and delivering a sheet, abutting the sheet against the conveying roller to form a loop of the sheet, extending the sheet bent at the conveying roller and feeding the sheet to the platen, detecting the sheet at an upstream side of the conveying roller and detecting the overlapping of the sheets at a downstream side of the conveying roller while the sheet bent at the conveying roller is extended and fed, and determining the overlapping according to a signal of detection of an overlapping condition of the sheets and a signal of detection of presence or absence of the sheet, said overlapping being determined by obtaining an overlapping signal of the sheet after the loop in the sheet is extended by the conveying roller, and judging the overlapping signal as an effective signal when the overlapping signal is obtained within a predetermined time since a rear edge of the sheet is detected at the downstream side relative to the conveying roller.

16. A method of detecting overlapping of a sheet according to claim 15, wherein in a step of determining the overlapping, it is determined whether the sheet is located at the conveying roller from the signal of detecting the sheet to validate the signal of detecting the overlapping when the signal of detecting the overlapping condition is sent.

17. A method of detecting overlapping of a sheet according to claim 15, further comprising counting said predetermined time since the rear edge of the sheet is detected, said sheet being gripped by the conveying roller within said predetermined time.

* * * * *